US007844066B2

(12) United States Patent
Sauer et al.

(10) Patent No.: US 7,844,066 B2
(45) Date of Patent: Nov. 30, 2010

(54) IN-THE-EAR HEARING AID HAVING AN ELECTRONICS MODULE

(75) Inventors: Joseph Sauer, Strullendorf (DE); Christian Schmitt, Grossenseebach (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 1133 days.

(21) Appl. No.: 11/509,211

(22) Filed: Aug. 24, 2006

(65) Prior Publication Data

US 2007/0047750 A1 Mar. 1, 2007

(30) Foreign Application Priority Data

Aug. 26, 2005 (DE) ..... 10 2005 040 542

(51) Int. Cl.
*H04R 25/00* (2006.01)

(52) U.S. Cl. ..... 381/328; 381/322

(58) Field of Classification Search ..... 381/312, 381/322, 324, 328
See application file for complete search history.

(56) References Cited

U.S. PATENT DOCUMENTS 5,201,008 A * 4/1993 Arndt et al. ..... 381/323

FOREIGN PATENT DOCUMENTS

DE 295 04 651 U1 6/1995
EP 0 629 101 B1 12/1994

* cited by examiner

*Primary Examiner*—Tuan D Nguyen

(57) ABSTRACT

An in-the-ear hearing aid is to have a more compact design. For this purpose there is inserted into a housing shell an electronics module having all the electronic components of the hearing aid, the electronic components being secured to a flexible supporting structure. As a result of the open construction of the electronics module, the individual electronic components can be compactly inserted with short stranded wires, thus also increasing electromagnetic compatibility. The flexibility of the supporting structure enables allowance to be made for individually differing auditory canal shapes.

13 Claims, 2 Drawing Sheets

IN-THE-EAR HEARING AID HAVING AN ELECTRONICS MODULE

CROSS REFERENCE TO RELATED APPLICATIONS

This application claims priority of German application No. 10 2005 040 542.8 filed Aug. 26, 2005, which is incorporated by reference herein in its entirety.

FIELD OF THE INVENTION

The present invention relates to an in-the-ear hearing aid having a housing shell for accurate-fit insertion into an auditory canal and having a flexible supporting structure to which substantially all the electronic components of the hearing aid are secured.

BACKGROUND OF THE INVENTION

The manufacture of in-the-ear hearing aids is very complicated because the devices are so small. In particular, the assembly of custom in-the-ear hearing aids is very labor-intensive. The aim of the manufacturing process is always to produce an aid of optimized size and cost.

In the manufacture of in-the-ear hearing aids it is generally known that pre-assembled electronics modules which incorporate the essential electronic components of the hearing aid can be integrated into custom shells in a concealed manner. One disadvantage of this, however, is the fact that optimum use cannot be made of the overall space available, which differs individually from one hearing aid to another. In addition, telephone coils and other antennae are frequently used, and their alignment when fitted depends on the individual shell. It is virtually impossible to align the coils once they are fitted, with the result that communication between the hearing aid and a telephone or between two hearing aids is often defective.

EP 0 629 101 B1 discloses an in-the-ear hearing aid having a supporting structure which is plastically deformable to a limited extent and which carries the electronic components of the hearing aid. A diaphragm is secured to the supporting structure in such a way that the supporting structure and the diaphragm form a molding chamber which has a molding channel open to the outside. The hearing aid is adapted to the individual auditory canal, in that the hearing aid is positioned in the ear and then the molding chamber is filled with a hardening plastic compound, the diaphragm being deformed and the resulting shaped member being shaped according to the auditory canal.

SUMMARY OF THE INVENTION

The object of the present invention is to reduce the size of the design of an in-the-ear hearing aid further, despite an increase in the range of functions.

According to the invention, this object is achieved by an in-the-ear hearing aid having a housing shell for accurate-fit insertion into an auditory canal and having a flexible supporting structure, to which substantially all the electronic components of the hearing aid are secured, the flexible supporting structure and the electronic components forming a module which can be removed from the housing shell in its entirety and/or can be inserted thereinto.

It is therefore advantageously possible to adapt an electronics module to the interior volume of an individually produced housing shell to the greatest extent possible. It is, moreover, possible to achieve an extremely compact construction and to select very short connecting wires, thus leading to improved electromagnetic compatibility (EMC).

Wiring elements for the electronic components are preferably integrated into the supporting structure. Further space can be saved by using wiring technology of this kind (insert molded).

Wiring elements for the electronic components can, however, also be secured to the supporting structure. The wiring is thus straightforward and easy to repair.

The housing shell is preferably manufactured individually for a hearing aid wearer. The electronics module can then be inserted into this pre-assembled shell. The hearing aid shell is especially advantageously manufactured using RSM (Rapid Shell Manufacturing) technology. One of the electronic components of the electronics module can be an electrical coil which can be aligned in a desired orientation on the supporting structure. At the time of assembly, the supporting structure should initially be shaped according to the space available inside the housing shell. The electronic components can then be inserted into the supporting structure, and the coil can be precisely aligned. The coil thus has the optimal orientation needed for communication.

In the broadest sense the supporting structure can also be an inner housing having at least one opening. The electronic components can then be inserted through this one opening or plurality of openings, thus finally producing the electronics module in its entirety.

BRIEF DESCRIPTION OF THE DRAWINGS

The present invention will now be explained in more detail with reference to the accompanying drawings, where.

DETAILED DESCRIPTION OF THE INVENTION

The exemplary embodiment described in more detail below is a preferred embodiment of the present invention.

Figure 1:
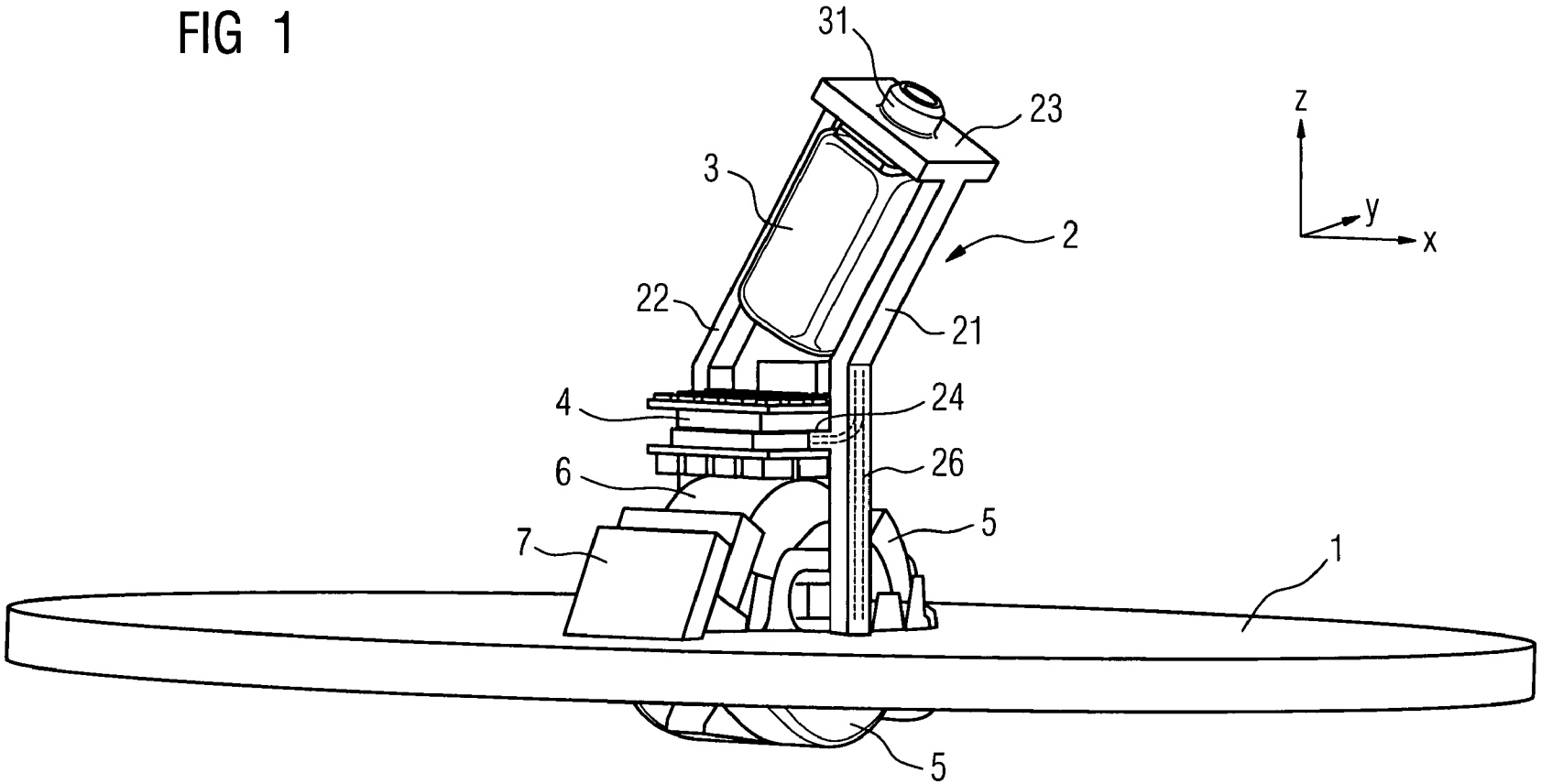
FIG. 1 shows an electronics module of an in-the-ear hearing aid from a first angle of view.

According to the example in FIG. 1, there is secured to the face plate 1 a supporting structure 2 having the function of an inner housing. The supporting structure here consists substantially of two rods 21 and 22 and of a plate 23 which joins the rods 21 and 22 at their free end.

Figure 2:
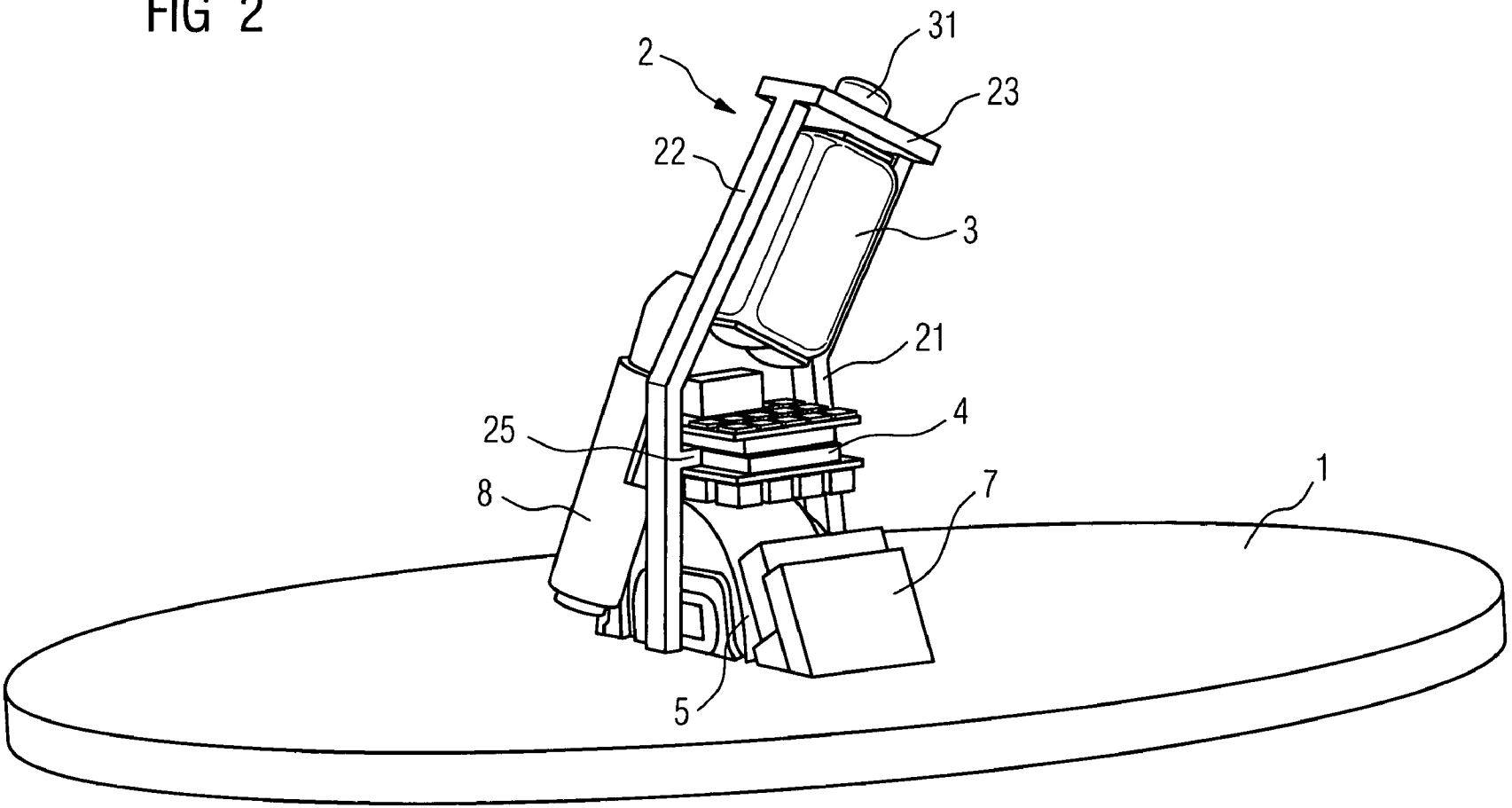
FIG. 2 shows the electronics module in FIG. 1 from another angle of view.

Located in the space between the rods 21 and 22 are the electronic components of the in-the-ear hearing aid. Thus, the stub 31 of the receiver 3 projects through a hole in the plate 23, and the body of the receiver 3 rests against the rods 21 and 22. Below the receiver, that is to say at the end of the receiver 3 opposite to the stub 31, there is located a signal processing circuit 4. In this case the circuit consists of two individual printed circuit boards which are secured to ribs 24 and 25 of the rods 21 and 22. This is also easy to see in FIG. 2.

Below the signal processing circuit 4 there is located a battery holder 5 including a battery 6, which is also fitted on the rods 21 and 22. The battery holder 5 projects through the face plate 1, enabling the battery 6 to be removed therefrom. Also visible are a microphone 7 and, especially in FIG. 2, a telephone coil 8 in the vicinity of the battery holder 5. Here the microphone 7 is attached to the battery holder 5, which thus also performs a supporting structure function. The telephone coil 8 is, however, at least partly secured to the rod 22.

The rods 21 and 22 of the supporting structure 2 are angled and thus form the typical auditory canal angle. However, since this angle differs from individual to individual, both about the x-axis and about the y-axis, the supporting structure 2 here is of a flexible design. This means that the supporting structure 2 can be bent according to the interior of an individually produced hearing aid shell.

The individual electronic components of the hearing aid can be assembled, prior to insertion into the hearing aid shell, to form a fully functioning hearing aid on the supporting structure 2. It is thus possible to attach the individual components to each other, as far as possible without interspaces. This produces the smallest possible construction and an optimal packing density. Furthermore, since the components are freely accessible, they can be optimally arranged so that the best possible system function can be ensured and so that disruptive interferences can be eliminated as far as possible.

Furthermore, as a result of the very compact construction, it is possible for very short stranded wires to be used for the electrical interconnection of the components. This results in an optimal construction in terms of electromagnetic compatibility (EMC), since the short stranded wires are only very weak antennae for the frequencies relevant in the hearing aid's signal processing system.

With the open construction the individual components are supported only by the supporting structure and are freely accessible. It is therefore possible to produce very complex aids with optimal alignment of the microphones and coils, that is to say with very high quality, in a relatively small space. It is thus also possible to prevent wires from breaking, as often happens with the conventional construction, if the electronic components are inserted into the aid shell one after the other. The open construction also makes repairs easier, however, since the components are readily accessible.

FIG. 1 also indicates that wiring 26 extends in the rod 21 of the supporting structure 22. This enables, for example the receiver 3, the signal processing circuit 4 and the battery 6 to be suitably electrically interconnected. Extra space can also be saved as a result of this wiring integrated into the supporting structure.

The inner housing or supporting structure 2 according to the invention permits a modular structure of all the electronics of the in-the-ear hearing aid. This electronics module can be inserted into any shell. This means that the present invention is not dependent on shell technology. In particular, therefore, an RSM shell or indeed any other standard otoplastic can be used for the construction of a hearing aid according to the invention.

The invention claimed is:

1. An in-the-ear hearing aid, comprising:

a housing shell that inserts into an auditory canal of a hearing aid wearer and fits the auditory canal; and a module that contains a flexible supporting structure securing substantially all electronic components of the hearing aid, wherein the module is removable from and inserted into the housing shell entirely.

2. The in-the-ear hearing aid as claimed in claim 1, wherein a wiring element for the electronic components is integrated into the supporting structure.

3. The in-the-ear hearing aid as claimed in claim 1, wherein a wiring elements for the electronic components is secured to the supporting structure.

4. The in-the-ear hearing aid as claimed in claim 1, wherein the housing shell is manufactured individually for the hearing aid wearer.

5. The in-the-ear hearing aid as claimed in claim 4, wherein the housing shell is manufactured using rapid shell manufacturing technology.

6. The in-the-ear hearing aid as claimed in claim 4, wherein the supporting structure is bent to fit an interior of the individually manufactured housing shell.

7. The in-the-ear hearing aid as claimed in claim 1, wherein one of the electronic components is an electrical coil which is aligned in an optimal orientation needed for communication.

8. The in-the-ear hearing aid as claimed in claim 1, wherein the electronic components are assembled on the supporting structure prior to inserting into the housing shell.

9. The in-the-ear hearing aid as claimed in claim 8, wherein the electronic components are assembled at an optimal packing density for electromagnetic compatibility.

10. The in-the-ear hearing aid as claimed in claim 8, wherein the electronic components are assembled at an optimal arrangement for a substantial elimination of a disruptive interference between the electronic components.

11. The in-the-ear hearing aid as claimed in claim 1, wherein the supporting structure is an inner housing having an opening.

12. The in-the-ear hearing aid as claimed in claim 11, wherein the electronic components are secured to the supporting structure by inserting through the opening.

13. A method for an in-the-ear hearing aid, comprising:

inserting a housing shell of the in-the-ear hearing aid into an auditory canal of a hearing aid wearer, the housing shell fitting the auditory canal; and forming a module by a flexible supporting structure securing substantially all electronic components of the hearing aid, the module being removable from and insertable into the housing shell entirely.

* * * * *